US005826972A

United States Patent [19]

Chiu

[11] Patent Number: 5,826,972

[45] Date of Patent: Oct. 27, 1998

[54] ELECTRIC TORCH

[76] Inventor: Si Fu Chiu, Unit 10, 19th Floor, Technology Plaza, 29-35 Sha Tsui Road, Tsuen Wan, New Territories, Hong Kong

[21] Appl. No.: 767,674

[22] Filed: Dec. 17, 1996

[30] Foreign Application Priority Data

Dec. 27, 1995 [GB] United Kingdom ..... 9526537

[51] Int. Cl.[6] ..... F21L 7/00

[52] U.S. Cl. ..... 362/188; 362/187; 362/202; 362/205

[58] Field of Search ..... 362/205, 206, 362/202, 203, 187, 188

[56] References Cited

U.S. PATENT DOCUMENTS 4,725,932 2/1988 Gammache .
4,807,097 2/1989 Gammache .
4,949,231 8/1990 Wang ..... 362/206
5,205,640 4/1993 Shin ..... 362/205
5,651,607 7/1997 Hou ..... 362/188

FOREIGN PATENT DOCUMENTS 2216998 10/1989 WIPO ..... 362/203

*Primary Examiner*—Thomas M. Sember
*Attorney, Agent, or Firm*—Miller, Sisson, Chapman & Nash, P. C.

[57] ABSTRACT

An electric torch comprising an aluminum barrel for accommodating a battery cell and having an open front end to provide a seat of a reduced cross-sectional size, a head piece releasably connected onto the body front end, a hollow reflector disposed within the head piece, and a light bulb. The light bulb has an electrically-conducting body sitting within the seat for direct electrical contact therewith and a glass envelope entering into the reflector for light reflection.

9 Claims, 1 Drawing Sheet

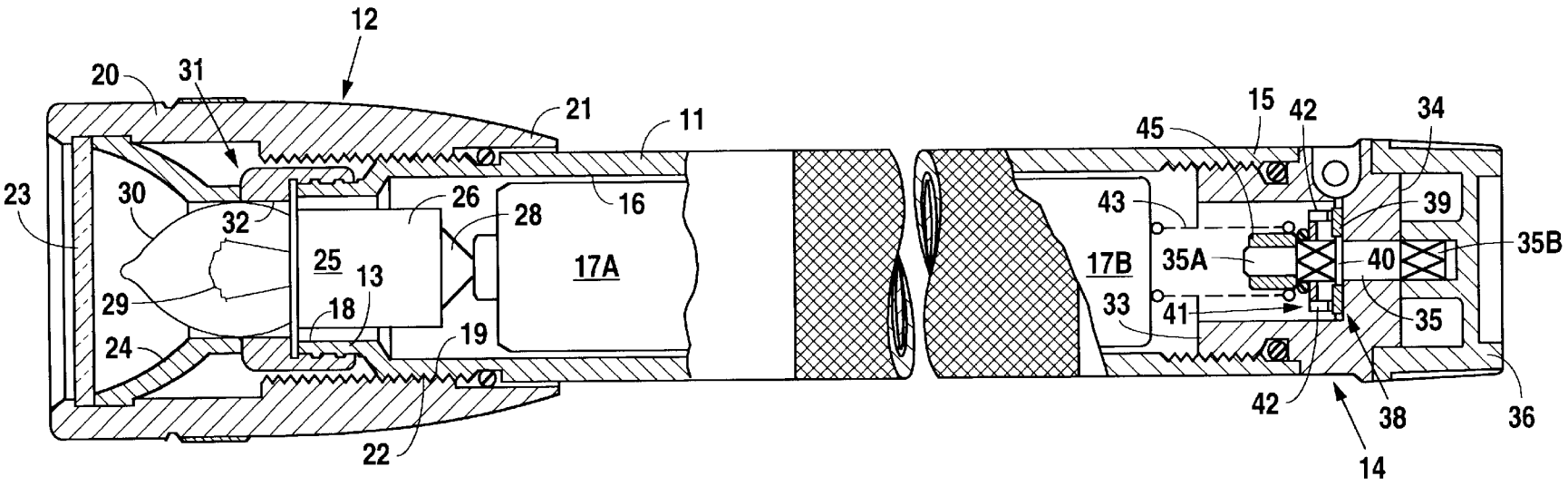
35B
36
34
39
35
40
38
14
42
42
15
45
35A
41
43
17B
33
11
16
17A
21
28
26
19
22
12
13
25
18
32
31
30
29
24
20
23

ELECTRIC TORCH

The present invention relates to an electric torch or flashlight which has a simplified electrical connection for a light bulb.

SUMMARY OF THE INVENTION

According to the invention, there is provided an electric torch comprising an electrically-conducting elongate body for accommodating a battery cell and having an open front end to provide a seat of a reduced cross-sectional size, an end piece releasably connected onto the body front end, a hollow reflector disposed within the end piece, and a light bulb having an electrically-conducting body sitting within the seat for direct electrical contact therewith and a glass envelope entering into the reflector for light reflection.

It is preferred that the seat is annular.

More preferably, the seat is in the form of a restricted cylindrical collar.

In a preferred embodiment, the body of the light bulb has a side protrusion for directly engaging the seat.

More preferably, the side protrusion is in the form of an annular flange for engaging a rim of the seat direct.

It is preferred that the body of the light bulb has a diameter of substantially 8 mm to 10 mm.

In a preferred embodiment, the electric torch includes a holder for holding the body of the light bulb in the seat.

More preferably, the holder is in the form of an apertured cap.

Even more preferably, the cap is screw-threaded onto the seat.

In a preferred embodiment, the electric torch includes a switch provided at a rear end of the body of the torch.

More preferably, the switch is operable by means of a knob which is turnable about a longitudinal axis of the body of the torch.

In a specific embodiment, the body of the torch is configured to accommodate at least one battery cell of type LR6 or AA.

BRIEF DESCRIPTION OF DRAWINGS

The invention will now be more particularly described, by way of example only, with reference to the accompanying drawing which is a cross-sectional side view of an embodiment of an electric torch in accordance with the invention.

DETAILED DESCRIPTION OF PREFERRED EMBODIMENT

Referring to the drawing, there is shown an electric torch 10 embodying the invention, which torch 10 comprises a tubular aluminum body in the form of a barrel 11, an end piece or head assembly 12 closing a front end 13 of the barrel 11 and another end piece or tail plug 14 closing a rear end 15 of the barrel 11. The barrel 11 is in itself electrically-conducting and defines a compartment 16 to accommodate a series of front and rear battery cells 17A and 17B (type LR6 or AA). The extremity of the barrel front end 13 has a reduced cross-sectional size or diameter, in the form of a restricted cylindrical collar, to define an annular seat 18. External screw threads 19 are formed immediately behind the seat 18.

The head assembly 12 has a generally tubular aluminum body 20 having a slightly converging rear end 21 within which internal screw threads 22 are formed for inter-engagement with the aforesaid screw threads 19 to releasably connect the head assembly 12 onto the barrel front end 13. The head assembly 12 includes a circular protection lens 23 mounted across the front end of the body 20 and a parabolic cup reflector 24 supported behind the lens 23.

The electric torch 10 has a light bulb 25 which has an electrically-conducting body 26 (having a diameter of about 8 mm–10 mm) including an integral annular flange 27 protruding from the side of and extending around the body front end and a separate electrically-conducting stud 28 provided at the center of the body rear end. The flange 27 and the stud 28 provide two separate electrical terminals for a light bulb filament 29 which protrudes centrally forwards of the body 26. The light bulb 25 further includes a bulb-like glass envelope 30 supported by the body 26 and enclosing the filament 29 in an inert gas, such as krypton, or vacuum environment. The envelope 30 extends forwards into the cup reflector 24 for light emitted from the filament 29 to be reflected out forwards through the lens 23.

The light bulb 25 sits within the seat 18 of the barrel 11, with its flange 27 pressed co-axially against the rim of the seat 18 for electrical connection therewith by means of an aluminum apertured cap 31 which fits around the seat 18 through screw-thread engagement. The cap 31 has a central hole 32 to accommodate the envelope 30 of the light bulb 25 when the cap 31 is screw-threaded over the seat 18 in order to hold the light bulb 25 in position. The stud 28 of the light bulb 25 is arranged to be in electrical contact with the anode of the front battery cell 17A.

The tail plug 14 has an electrically-conducting tubular base 33 which is screw-threaded into the rear end 15 of the barrel 11 for electrical connection therewith. Thus, the flange 27 of the light bulb body 26 is electrically connected to the base 33 of the tail plug 14 via the barrel 11. The base 33 has an integral end wall 34 through which a central shaft 35 passes. A plastic end cap or turning knob 36 is coupled co-axially with a rear end 35B of the shaft 35 for rotating the shaft 35. A front end 35A of the shaft 35 extends forwards into the base 33 through a plastic fixed washer 38 which lies against the inner side of the end wall 34. The washer 38 has four alternating solid and void quadrants 39 and 40, respectively.

An electrically-conducting washer 41 is carried co-axially on the shaft 35 immediately in front of the fixed washer 38. The washer 41 is rotatable by means of the turning knob 36 via the shaft 35. The rotatable washer 41 has a pair of diametrically-opposite spring legs 42 which are arranged to come into electrical contact with the end wall 34 of the base 33 through the respective void quadrants 40 of the fixed washer 38 or, alternatively, to be shielded therefrom by the respective solid quadrants 39, depending on the angular position of the turning knob 36. The cooperation between the base end wall 34 and the rotatable washer 41 provides a switching action.

An electrically-conducting compression coil spring 43 is supported co-axially on the front end 35A of the shaft 35 by means of a tubular connector 45 which is press-fit over the extremity of the shaft front end 35A. The spring 43 is in electrical contact at its rear end with the rotatable washer 41, and extends forwards to act upon the rear battery cell 17B, for electrical connection therewith, in order to bring the rotatable washer 41 into electrical connection with the cathode of the rear battery cell 17B. The spring 43 also pushes the rear and in turn the front battery cell 17B/17A forwards against the stud 28 of the light bulb 25.

While the stud 28 (one terminal) of the light bulb 25 is always in electrical contact with the anode of the front battery cell 17A, the said switching action between the base end wall 34 and the rotatable washer 41 controls the electrical connection of the flange 27 (the other terminal) of the light bulb 25 to the cathode of the rear battery cell 17B. Depending on the angular position of the turning knob 36, the light bulb 25 is therefore switchable on and off.

The direct contact of one terminal (the flange 27/the body 26) of the light bulb 25 with (the front end 13 of) the barrel 11 not only simplifies the electrical connection therebetween but also permits the use of conventional light bulbs having a body of a diameter of about 8 mm–10 mm, which are far much cheaper and readily available, as opposed to relatively much smaller standard light bulbs for aluminum torches, said standard light bulbs having a body of a diameter of about 4 mm. The said conventional light bulbs include, apart from the one having an annular flange as described above, a similar one having a body which has more or less the same diameter and is screw-threaded but without a said annular flange.

In a slightly different embodiment for the use of the conventional light bulb having a screw-threaded body, the front end 13 of the barrel 11 may be suitably modified for the body to be directly screw-threaded into the barrel front end 13 or inserted therein and held in electrical contact therewith by means of a suitable holder, for example, similar to the cap 31.

The invention has been given by way of example only, and various other modifications of and/or alterations to the described embodiments may be made by persons skilled in the art without departing from the scope of the invention as specified in the appended claims.

What is claimed is:

1. An electric torch comprising:

an electrically-conducting elongate body for accommodating a battery cell and having an open front end to provide a rimmed, annular seat of reduced cross-sectional size;

an end piece releasably connected onto a body front end;

a hollow reflector disposed within said end piece; and a light bulb having an electrically-conducting body sitting within said seat and a glass envelope entering into said reflector for light reflection, said light bulb having an annular flange engaging said rim of said seat for direct electrical contact with said seat.

2. An electric torch as claimed in claim 1, wherein said seat is a restricted cylindrical collar.

3. An electric torch as claimed in claim 1, wherein said body of said light bulb has a diameter of substantially 8 mm to 10 mm.

4. An electric torch as claimed in claim 1, including a holder for holding said body of said light bulb in said seat.

5. An electric torch as claimed in claim 4, wherein said holder is an apertured cap.

6. An electric torch as claimed in claim 5, wherein said cap is screw-threaded into said seat.

7. An electric torch as claimed in claim 1, including a switch provided at a rear end of said body of said torch.

8. An electric torch as claimed in claim 7, wherein said switch is operable by means of a knob rotatable about a longitudinal axis of said body of said torch.

9. An electric torch as claimed in claim 1, wherein said body of said torch accommodates at least one battery cell of type LR6 or AA.

* * * * *